United States Patent [19]

Tupper

[11] Patent Number: 4,905,606

[45] Date of Patent: Mar. 6, 1990

[54] SAFETY ATTACHMENT SYSTEMS, AND PARTS AND FITTING THEREFOR

[75] Inventor: Alan W. Tupper, Chippenham, England

[73] Assignee: Latchways Limited, Chippenham, England

[21] Appl. No.: 247,165

[22] Filed: Sep. 21, 1988

[30] Foreign Application Priority Data

Sep. 22, 1987 [GB] United Kingdom ..... 8722253

[51] Int. Cl.[4] ..... B61B 7/00; B61B 12/04

[52] U.S. Cl. ..... 104/113; 104/182; 105/151

[58] Field of Search ..... 105/151; 104/113, 115, 104/182, 196, 93, 112; 182/5, 10

[56] References Cited

U.S. PATENT DOCUMENTS

| | | | |
|---|---|---|---|
| 857,924 | 6/1907 | Crandall | 105/151 X |
| 2,953,116 | 9/1960 | Lund | 105/151 X |
| 3,018,738 | 1/1962 | Naud | 105/151 |
| 4,265,179 | 5/1981 | Tupper | 104/182 |
| 4,462,316 | 7/1984 | Tupper | 105/151 |
| 4,470,354 | 9/1984 | Tupper | 105/151 X |

FOREIGN PATENT DOCUMENTS

| | | |
|---|---|---|
| 1582201 | 1/1981 | United Kingdom . |
| 2096958A | 10/1982 | United Kingdom . |

*Primary Examiner*—Robert J. Oberleitner

*Attorney, Agent, or Firm*—Frishauf, Holtz, Goodman & Woodward

[57] ABSTRACT

A linkage mechanism for a safety attachment system in which a pair of traversing devices are engaged with an elongate safety line for sliding movement therealong past intermediate securing devices for the safety line. The traversing devices are coupled to the mechanism, and a lanyard connected to the mechanism applies a force thereto, when the lanyard is under tension, in a direction generally away from the safety line. The mechanism is adapted to cause relative movement of the traversing devices along the safety line when the force is applied thereto by the lanyard. An actuator, preferably using a spring, is provided in the mechanism to cause opposite relative movement of the traversing devices when the force is reduced.

13 Claims, 5 Drawing Sheets

FIG. 1A.
(PRIOR ART)
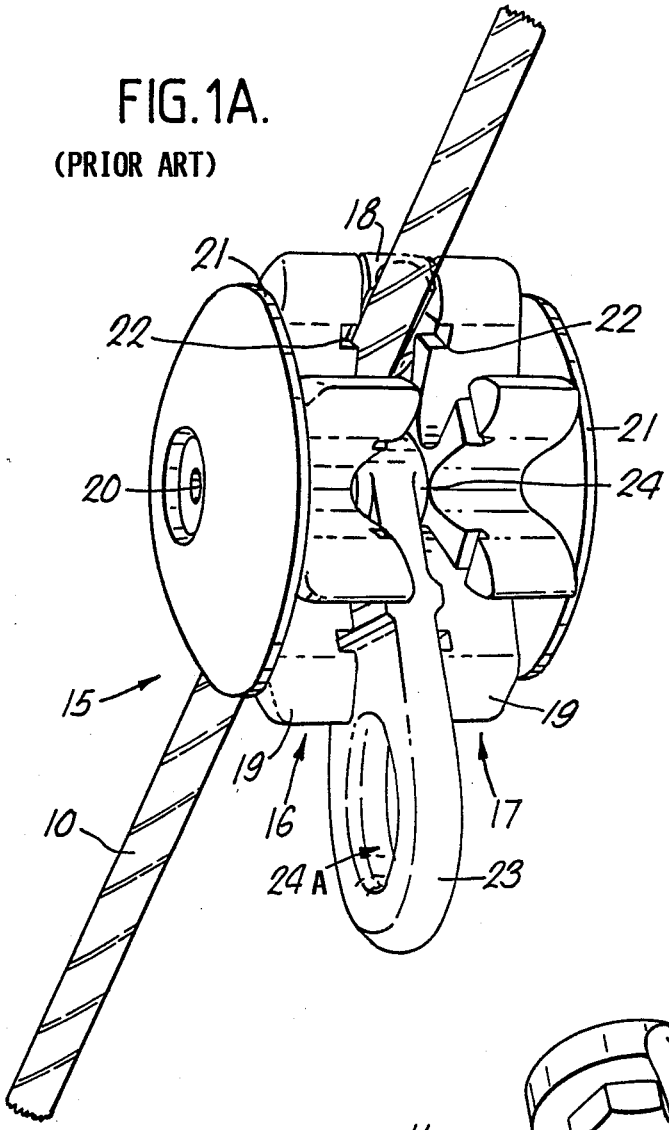
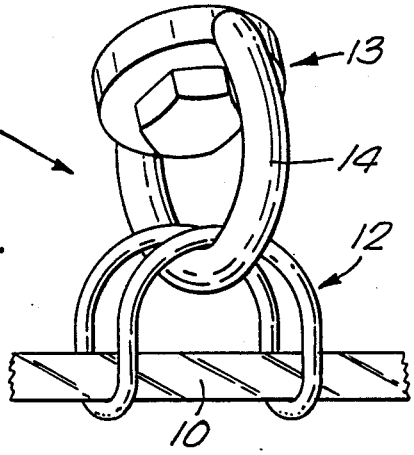
FIG. 1B.

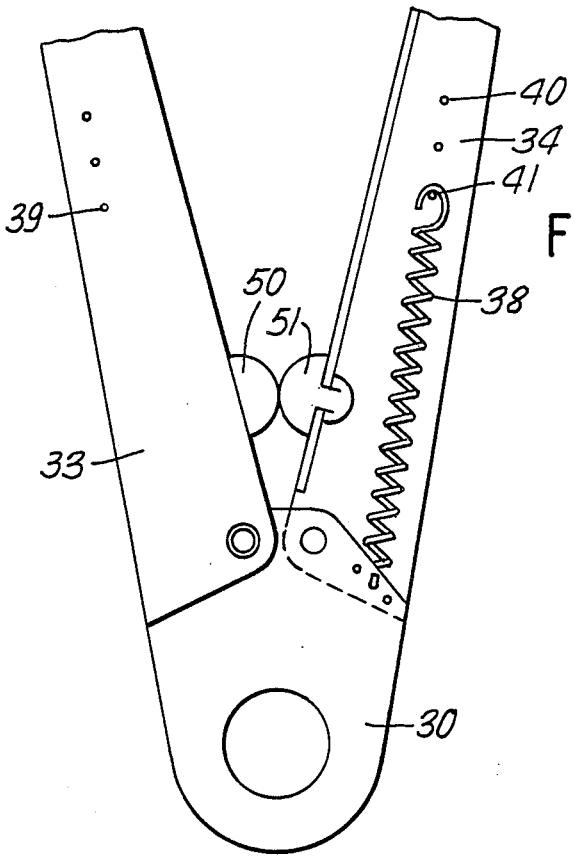
FIG. 6.
FIG. 7.
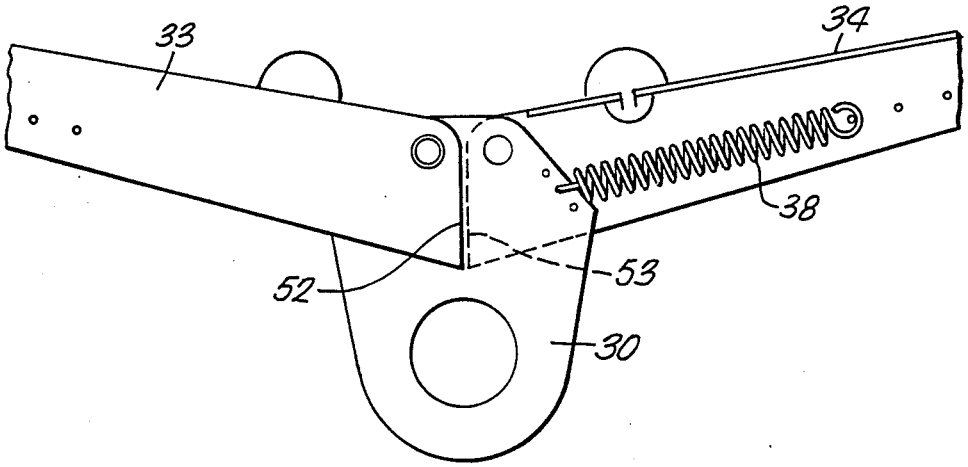

SAFETY ATTACHMENT SYSTEMS, AND PARTS AND FITTING THEREFOR

FIELD AND BACKGROUND OF THE INVENTION

This invention relates to safety attachment systems, and parts and fittings therefor.

A safety attachment system comprising a securely fastened life line allows personnel to move along the general path of the life line while being attached thereto by means of a harness having a lanyard provided at its free end with a fastener engagable with the life line for sliding movement therealong. If the fastener is in the form of a clip, it is necessary to detach the clip with the life line at each immediate fixed location point along the length of the life line and then re-engage the clip with the life line on the other side of the location point. British Patents Nos. 1,582,201 and 2,096,958, and U.S. Pat. Nos. 4,265,179 and 4,462,316, describe traversing devices can be located as a sliding fastener at the end of a safety harness lanyard for engagement with a life line enabling passage past the intermediate location points of the life line without detachment of the fastener from the life line.

When the life line is positioned at an elevated location high above a person secured with respect thereto, certain problems can occur in safety attachment systems utilizing the aforesaid traversing devices and the relatively long lanyards necessary for such applications. A first problem is that because a relatively long lanyard is used, the traversing device engaged with the overhead life line tends to lag behind the movements of the attached person so that on falling, the person can swing dangerously back and forth, like a pendulum, over a relatively long arc length. Another problem which can occur is that the extended length of the lanyard reduces the angle of swing of the pivotal load connector element of the traversing device, so that the tension in the lanyard produces a more generally downward force on the transfastener which can result in a jamming effect when the transfastener engages an intermediate support hanger of the life line.

SUMMARY OF THE INVENTION

The invention is concerned with providing an improved safety attachment system and fittings therefor which provide a better operation when an elevated safety line is employed.

The invention provides a linkage mechanism for use in a safety attachment system in which a pair of traversing devices are engaged with an elongate safety line for sliding movement therealong past intermediate securing means for the safety line, which mechanism comprises means for attaching a pair of traversing devices to the mechanism; means for attaching a lanyard connector to the mechanism so as to apply, in use, a force thereto in a direction generally away from the safety line, when the lanyard is under tension loading, the mechanism being adapted to cause relative movement of the traversing devices along said safety line, when said force is applied thereto; and actuating means, e.g. resilient means, to cause opposite relative movement of the traversing devices along said line, when said force is reduced.

In some embodiments of the invention, said link mechanism may comprise a pair of pivotally mounted arms arranged in a generally V-shaped configuration, the arms being adapted at their free ends for attachment to pivotal load connector member provided on the traversing devices respectively; said means for attaching a lanyard connector to the mechanism acting so as to apply, in use, a downward force to the mechanism, when the lanyard is tensioned, to reduce the angle between the arms thereof thereby causing a relative movement of the traversing devices towards one another along the safety line; and said actuating means acting to increase the angle between said arms, when said lanyard tension is reduced, to cause relative movement of the traversing devices away from one another along the safety line.

According to a feature of the invention, said resilient means may be adjustable to enable the forces applied thereby to be altered.

According to another feature of the invention, the end of each arm may be provided with an attachment element pivotally mounted thereon about the longitudinal axis of the arm, for connection to the load connector member of a respective traversing device to permit the traversing devices to negotiate curved sections of the safety line.

In some embodiments, the link mechanism may comprise a hub member to which a lanyard connector can be attached, with said arms being pivotally mounted on the hub member and with said resilient means acting between the hub member and each arm. Said resilient means may comprise a tension spring connected between said hub member and each arm. A series of different attachment points may be provided for the ends of the tension springs on the hub and/or the arms to enable different spring tensions to be applied to the arms.

Two pairs of cooperating stop means may be provided on the arms for engagement with one another to limit the extreme relative pivotal movements of the arms towards one another, and away from one another, respectively.

Said hub member may have a slot which is elongate in a direction generally parallel to the safety line, to receive a lanyard connector, e.g. a safety hook, which moves to a respective end of the slot depending on the direction of movement of the attached person.

The invention includes a safety attachment system comprising an elongate safety line, means for securing the safety line to an overhead fixed structure at the ends of the line and at one or more intermediate locations therealong, a pair of traversing devices for sliding engagement along the safety line and adapted to traverse the, or each, intermediate securing means of the safety line without detachment from the line, and a link mechanism as aforesaid.

In such safety attachment systems, each traversing device may comprise at least one wheel having recesses formed in its periphery at spaced locations therearound and separated by projecting parts of the wheel; a cooperating slipper member mounted on the wheel to form a unitary structure therewith, and adapted and arranged to allow rotation of the wheel about its axis with respect to the slipper member while locating the elongate safety line with respect to the wheel such that when the device is moved along the safety line, intermediate support members for securing the safety line to a fixed structure, are received, guided and passed through the device in the recesses of the wheel which then rotates relative to the slipper member whilst the safety line is located with respect to the wheel by the slipper member; and load connector element pivotally mounted on the traversing device. In some embodiments a pair of said wheels may be provided with said slipper member having at least a portion extending between the wheels. The load connector element is preferably pivotally mounted about the rotary axis of the wheel or wheels and projects radially outwardly of the periphery thereof. The slipper member and said projecting parts of the wheel(s) may have arcuate interengaging means, e.g. cooperating arcuate grooves and projections therebetween to provide a location of the slipper member relative to the wheel(s) whilst allowing relative rotation thereof.

The invention further includes a safety attachment system as aforesaid when installed with said safety line secured by said securing means with respect to an elevated fixed structure.

BRIEF DESCRIPTION OF THE DRAWINGS

An embodiment of the invention will now be described by way of example and with reference to the accompanying drawings, in which:

FIG. 1A is a perspective view of a prior art traversing device for use in a safety attachment system embodying the invention;

FIG. 1B is a side view of a hanger member for a steel cable of the safety attachment system;

FIGS. 6 and 7 are side views partly in cross-section of central portions of the mechanism of FIG. 2 illustrating respective extreme positions of movement of the arms of the mechanism;

DESCRIPTION OF THE PREFERRED EMBODIMENTS

Figure 1C:
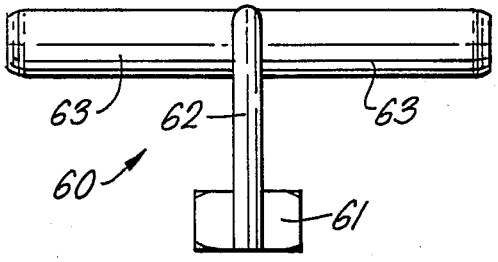
FIGS. 1C–1F are, respectively, a side view, an end view, a plan view and a vertical cross-section of an alternative form of hanger member.
Figure 1D:
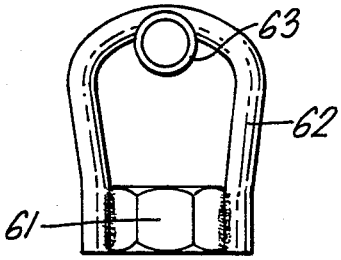
Figure 1F:
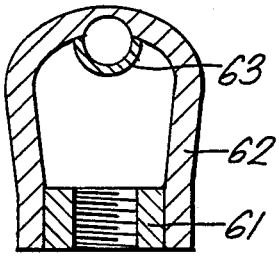
Figure 1E:
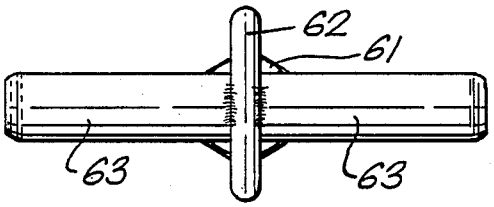

Referring to FIGS. 1A and 1B of the drawings, a safety attachment system for people working at elevated locations includes a life line in the form of a steel cable (10) which is fastened to an overhead fixed structure. The remote ends of the line are provided with suitable end fittings which can be bolted or otherwise similarly firmly attached to mounting points depending from the overhead fixed structure. The cable (10) is guided along a selected path by a number of intermediate locating means, one of which is indicated in FIG. 1B and designated with the reference numeral (11). The suspension means comprises an endless hanger element (12) made of a rod-like material to define a pair of downwardly projecting loop portions through which the wire (10) passes. The hanger member (12) is attached to the overhead fixed structure by a retaining element (13) comprising a base which is bolted to the overhead fixed structure and an integral depending U-shaped part (14) which engages around the central portion of the hanger member (12).

FIGS. 1C–1F illustrate another possible form of hanger (60) for the steel cable (10). The hanger (60) comprises a mounting portion (61) constituted by a hexagonal nut having welded thereto a single loop-portion (62). The cable (10) is passed through axially aligned hollow tubular members (63) welded to the base of the loop portion (62) of the hanger to project on respective opposite sides thereof.

A safety attachment system according to the invention is intended for applications where only high, remote structures which are considerably elevated above a working position, are available for location of the safety life line. An example of such an application would be for securing workers carrying out maintenance of an aircraft in a hangar. Examples of other similar applications are work in warehouse loading bays, loading stations of road and rail containers, dam face work and cooling tower work.

The path defined by the life line (10) can include sections which are non-linear. For example where a curved section is required, the wire can be passed through a curved tube of the required radius of curvature with suitable hanger members fixedly secured thereto.

To provide a sliding attachment with a safety line, in a safety attachment system according to the invention, a pair of traversing devices (15) (one of which is shown in FIG. 1A, are used. Each traversing device may be of the general type described in British Patent Specifications 1,582,201 and 2,096,958 and corresponding U.S. Pat. Nos. 4,265,179 and 4,462,316. A traversing device (15) comprises a pair of spaced apart wheel elements (16 and 17) with a slipper member (18) being located between the wheels at a peripheral portion thereof. Each wheel (16,17) is formed with a plurality, for example seven, radially projecting portions (19) which define therebetween seven equi-angularly spaced recesses in the periphery of the wheel. The wheels are rotatably mounted on an axle (20). Each wheel is provided with a metal disc (21) located against an end face of the associated wheel which is remote from the other wheel, to extend partway along each recess defined in the periphery of the wheel. These discs (21), which are superficially mounted with resilient buffer elements, inhibit engagement of the wire (10) in one of the recesses defined in the wheel so as to inhibit "winding-out" of the wire (10) from the traversing device (15) on rotation of the wheel relative to the slipper member (18). Without the disc and buffer members, such engagement of the wire (10) in a recess in one of the wheels followed by subsequent rotation of the wheel relative to the slipper member could result in complete detachment of the traversing device from the wire (10).

The slipper member (18), positioned between the wheels at the peripheries thereof, has a pair of axially projecting, arcuate flanges which engage in corresponding shaped grooves (22) formed in the inner confronting surfaces of the projecting parts (19) of the wheels, thereby to locate the slipper member in position between the wheels while allowing the wheels to rotate complete revolutions in either direction with respect to the slipper member (18). In this way, the depending loop sections of the hanger elements (12) which contain the wire (10), can be received in a pair of corresponding recesses in the wheels and can pass through the device in such recesses as the wheels then rotate relative to the slipper member (18) with the depending sets of parallel arms of the hanger elements (12) embracing the slipper member (18). In this way, the traversing device (15) can move along the wire (10) past the locating hanger element or elements therefor, without being detached from the wire (10).

Each traversing device (15) further includes a pivotally mounted load connected element (23) having at one end a boss (24) which is bored so that it is pivotally located on the axle (20) of the traversing device. The connector element (23) projects radially outwardly of the wheels (16,17) and has an aperture 24A for receiving a connector element.

If the safety harness of a worker is connected by a lanyard directly to the load connector element (23) with a single traversing device (15) for securing the worker, it has been found that certain problems can arise in applications where the cable (10) is suspended from an overhead fixed structure which is at a great distance above the working position. In such a situation, the connection requires the use of a relatively long lanyard. The angle through which the load connector element (23) pivots is then substantially reduced as compared to other applications where a relatively short lanyard can be used. It has been found that the traversing device (15) tends to lag behind the movements of an attached person in the direction of the safety cable (10) so that a person who falls can then be swung dangerously backwards and forwards in the fashion of a pendulum, over an increased arc length which results from the use of a relatively long lanyard. A further problem which has been encountered is that, owing to the reduced angle of swing of the load connector element (23), the direction of the force applied to the traversing device by the tension in the lanyard is such that the force is often ineffective in moving the traversing device (15) past each suspending hanger element (12).

In order to minimize or overcome these problems, a safety attachment system in accordance with the invention utilizes a pair of traversing devices (15) engaged with the safety wire (10) together with an additional linkage mechanism as shown in FIGS. 2 to 9 of the drawings for interconnecting the traversing devices and providing a common connection point for a safety hook attachment of a harness lanyard.

The linkage mechanism comprises a hook plate (30) which has an aperture (31) for receiving the lanyard safety hook. A pair of arm (33,34) are pivotally mounted on the hook plate (30). Each arm has a generally U-shaped cross-section with a recess (35) (FIG. 3) formed in an end section of the base of the U-section arm to allow the lower end of the arm to embrace an upper portion of the hook plate (30) and to allow pivotal movements of the arm with respect thereto. Each arm is pivotally mounted on a pin (36,37) which passes through aligned apertures in the side walls of the arms (33,34) and in the hook plate (30). Tension springs (38) are connected between the arms (33,34) and the hook plate (30) as illustrated in FIGS. 6 and 7. Aligned apertures (39,40) are provided in the opposed side walls of the arms (33,34) at spaced locations along intermediate portions of the arms. A cotter pin (41) can be engaged in a selected pair of such apertures (39,40) to provide at end connection for one end of a tension spring (38). At either side of the upper edge of the hook plate (30), a respective set of three apertures (42,43) are provided for selectively receiving the opposite end of a tension spring (38). Therefore the biassing force applied by the tension spring (38) to each arm can be adjusted by selecting the various options of end connection positions for the respective opposite ends of the tension spring (38).

The free ends of the arms (33,34) are each provided with a swivel clevis connector for connection to the load connector element (23) of a respective traversing device (15). Each such clevis connector (45), which is illustrated in greater detail in FIGS. 4 and 5, comprises a clevis element (46) having a cylindrical shank (47) which engages in a circular bushing (48) contained within and secured at the free end of a respective arm (33,34). This arrangement permits the clevis connector (46) to swivel about an axis extending in the longitudinal direction of the arm (33,34). The amount of such swivelling motion is limited by the provision of a pin (49) which extends transversely through the projecting free end of the shank (47). The extreme positions of the swivelling motion of the clevis connector (46) are governed by engagement of the lower projecting portion of the pin (49) with the respective side walls of the arm (34). The parallel arms of the clevis are formed with aligned apertures (50) to allow connecting means to be passed therethrough and through the aperture (24) in the load connector element (23) of a corresponding traversing device (15) which is engaged between the arms of the clevis. The swivelling clevis connectors (45) allow the traversing devices (15) attached thereto a certain amount of freedom to pivot in vertical planes to allow the passage of the traversing devices and the linkage mechanism associated therewith to negotiate non-linear sections of the safety cable (10), whilst maintaining the traversing devices (15) in the required generally vertical planes for correct presentation to the suspension hanger elements (12) for passage through the traversing devices during a traversing operation.

A lanyard safety hook is engaged in the aperture (31) of the hook plate (30) so that the linkage mechanism applies actuating forces through its arms (33,34) to each traversing device in a direction approximating the direction of a load applied thereto in other applications where a relatively short lanyard can be used. Therefore the angle of swing of the load connector elements (23) of the traversing devices, with respect to the vertical, is increased compared to use of a single traversing device to which a relatively long lanyard is directly connected, and this facilitates the traversing of the intermediate hanger elements of the steel cable (10).

Figures 2, 3, 4, 5:
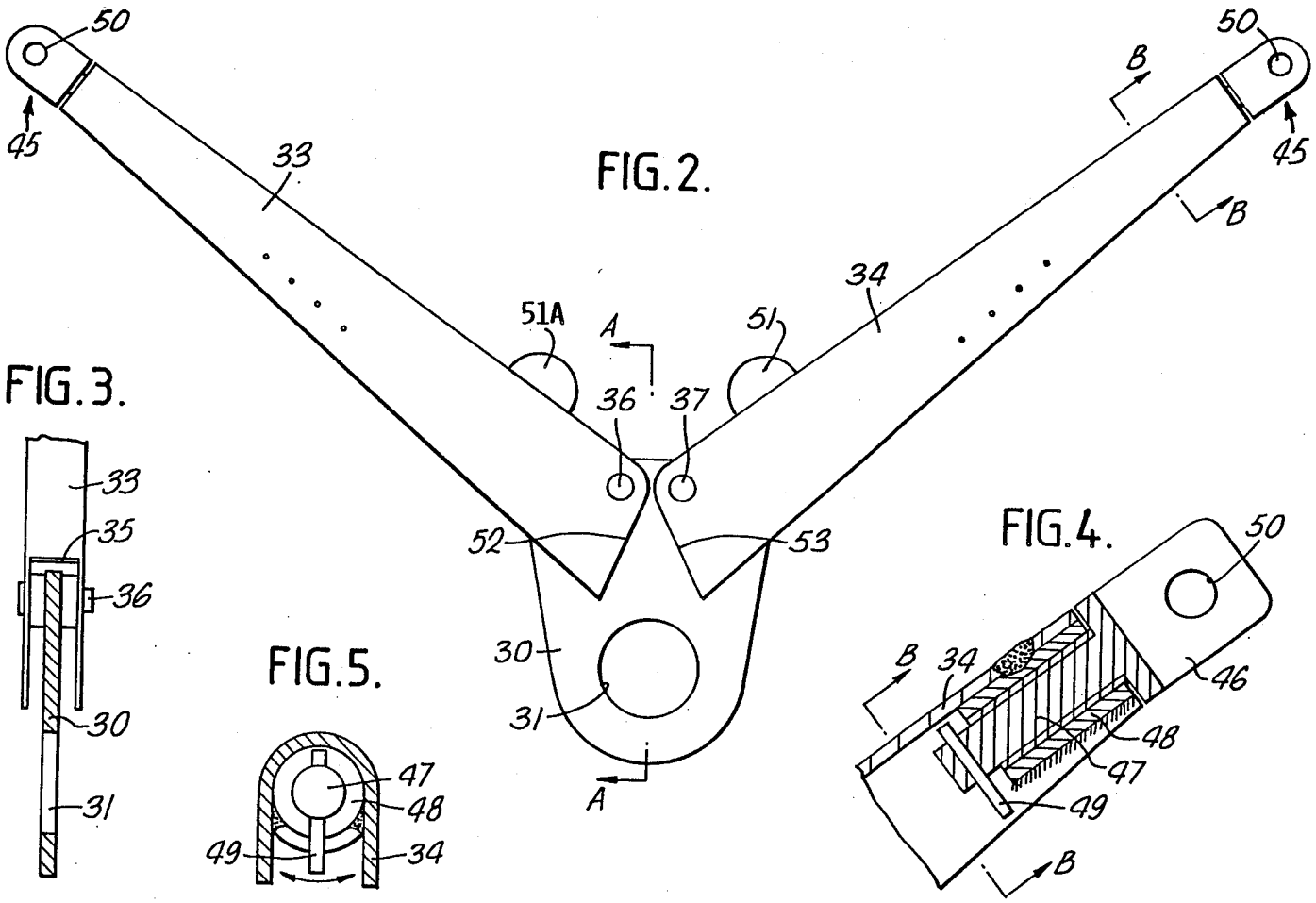
FIG. 2 is a side view of a link mechanism embodying the invention.
FIG. 3 is a cross-section along A—A in FIG. 2.
FIG. 4 is a fragmentary section of an end section of an arm of the mechanism of FIG. 2.
FIG. 5 is a cross-section along B—B in FIGS. 2 and 4.

The degree of tension applied to the arms (33,34) by the tension springs (38) is adjusted for each application so as to provide a static equilibrium position as generally indicated in FIG. 2 with the arms (33,34) generally midway between their extreme positions of movement which are illustrated respectively in FIGS. 6 and 7 of the drawings. Resilient buffer members (51,51A) are fitted to the arms (33,34) on the upper surfaces thereof, for engagement with one another, as shown in FIG. 6, to limit movement of the arms towards one another. The lower end surfaces (52,53) of the arms are shaped to provide abutments which engage one another as shown in FIG. 7, to limit movement of the arms in a direction away from one another.

An attachment person moving in one direction along the path of the safety cable (10) transmits a linear force in the forward direction of movement as well as producing up and down movements of the lower end connection point between the lanyard and the safety harness. This results in the hook plate (30) being pulled downwardly which causes the arms (33,34) to move against the action of the tension springs (38) so as to reduce the angle between the arms thereby causing relative movement of the traversing devices (15) carried at the ends of the arms, towards one another. When the tension in the lanyard is then released, the tension springs (38) cause the arms (33,34) to move so as to increase the angle therebetween thereby causing relative movement of the transfastener devices away from one another along the length of the cable (10). This continues as a dynamic oscillating movement of the transfasteners towards and away from one another along the length of the cable (10). This dynamic oscillating movement coupled with the linear force applied to the linkage in the direction of forward movement of the attached person has the effect of causing the linkage and the transfastners to move along the safety cable (10) so as to keep the point of attachment to the hook plate (30) more nearly above the attached person which together with the effectively shortened lanyard, reduces the likelihood of the aforesaid pendulum effect occurring when the attached person falls. This induced motion in the linkage and transfastener assembly also provides a driving force to negotiate both the hanger suspension points as well as any required changes in direction of the safety wire (10). Excessive oscillating movements of the linkage mechanism are inhibited by the aforesaid buffer stops (51,51A) and abutment surfaces (52,53) provided on the arms (33,34).

Figure 9:
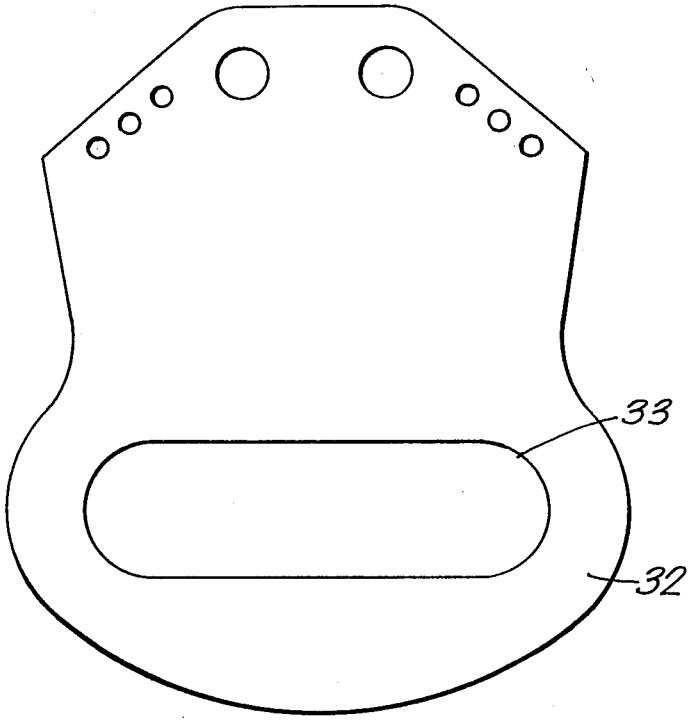
FIG. 9 is a side view of an alternative hook plate for the mechanism of FIG. 2.
Figure 8:
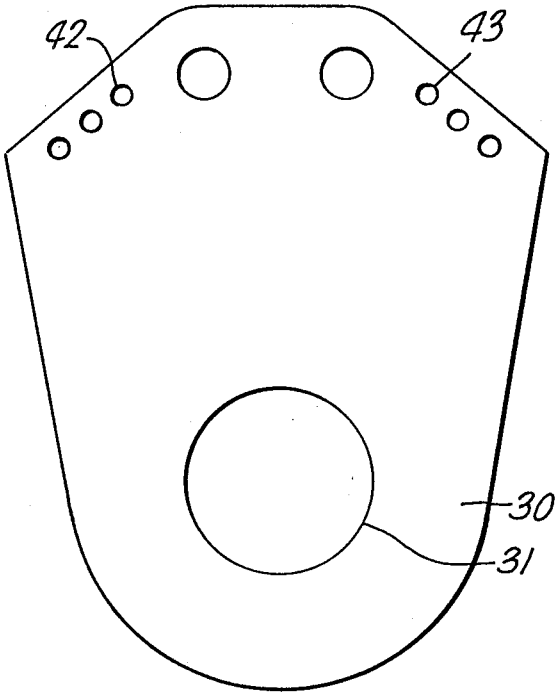
FIG. 8 is a side view of the hook plate of the mechanism of FIG. 2.

FIG. 9 shows an alternative form of hook plate (32) which has a slot (33) for engagement of the lanyard safety hook, which slot extends generally parallel to the direction of the safety cable (10). Depending on the direction of movement of the attached person along the safety cable, the lanyard safety hook would be moved to one end or other of the slot (33) to provide an additional biasing effect for causing the linkage mechanism and transfastener assembly to move in the required direction along safety cable (10).

I claim:

1. A linkage mechanism for use in a safety attachment system in which each of a pair of traversing devices is engaged with an elongate safety line for sliding movement therealong past intermediate securing means for the safety line and is provided with a pivotal load connector member, which mechanism comprises a pair of pivotally mounted arms arranged in a generally V-shaped configuration and being pivotally mounted on a hub member, the arms being adapted at their free ends for attachment, respectively, to a pivotal load connector member provided on the traversing devices; means for attaching an end connector of a lanyard to the hub member so as to apply a force to the mechanism, when the lanyard is tensioned, to reduce the angle between the arms thereof thereby causing a relative movement of the traversing devices toward one another along the safety line; and actuating means acting between the arms and the hub member to increase the angle between said arms, when said lanyard tension is reduced, to cause relative movement of the traversing devices away from one another along the safety line.

2. A mechanism according to claim 1 wherein said actuating means comprise resilient means.

3. A mechanism according to claim 2 wherein said actuating means include adjustment means to enable the force applied by the resilient means to be altered.

4. A mechanism according to claim 3, wherein said adjustable resilient means comprise a series of different attachment points provided for the ends of the tension springs on at least one of the hub and the arms to enable different spring tensions to be applied to the arms.

5. A mechanism according to Claim 2 wherein said resilient means comprise a tension spring connected between said hub member and each arm.

6. A mechanism according to claim 1 wherein the end of each arm is provided with an attachment element pivotally mounted thereon about the longitudinal axis of the arm, for connection to the load connector member of a respective traversing device to permit the traversing devices to negotiate curved sections of the safety line.

7. A mechanism according to claim 1 wherein two pairs of cooperating stop means are provided on the arms for engagement with one another to limit the extreme relative pivotal movements of the arms towards one another, and away from one another, respectively.

8. A safety attachment system according to claim 1, each traversing device comprises at least one wheel having recesses formed in its periphery at spaced locations therearound and separated by projecting parts of the wheel; a cooperating slipper member mounted on the wheel to form a unitary structure therewith, and adapted and arranged to allow rotation of the wheel about its axis with respect to the slipper member while locating the elongate safety line with respect to the wheel such that when the device is moved along the safety line, intermediate support members for securing the safety line to a fixed structure, are received, guided and passed through the device in the recesses of the wheel which then rotates relative to the slipper member while the safety line is located with respect to the wheel by the slipper member; and a load connector element pivotally mounted on the traversing device.

9. A mechanism according to claim 1 wherein said hub member has a slot which is elongate in a direction generally parallel to the safety line to receive said lanyard end connector, whereby said lanyard end connector moves to a respective end of the slot depending on the direction of movement of the attached person.

10. A linkage mechanism for use in a safety attachment system in which a pair of traversing devices are engaged with an elongate safety line for sliding movement therealong past intermediate securing means for the safety line, which mechanism comprises a pair of pivotally mounted arms arranged in a generally V-shaped configuration, the end of each arm being provided with an attachment element pivotally mounted thereon about the longitudinal axis of the arm, for connection to a load connector member of a respective traversing device to permit the traversing devices to negotiate curved sections of the safety line; means for attaching an end connector of a lanyard to the mechanism so as to apply a force to the mechanism, when the lanyard is tensioned, to reduce the angle between the arms thereof thereby causing a relative movement of the traversing devices towards one another along the safety line; and actuating means acting to increase the angle between said arms, when said lanyard tension is reduced, to cause relative movement of the traversing devices away from one another along the safety line.

11. A linkage mechanism for use in a safety attachment system in which each of a pair of traversing devices is engaged with an elongate safety line for sliding movement therealong past intermediate securing means for the safety line and is provided with a pivotal load connector member, which mechanism comprises a pair of pivotally mounted arms arranged in a generally V-shaped configuration, the arms being adapted at their free ends for attachment, respectively, to a pivotal load connector member provided on the traversing devices; means for attaching an end connector of a lanyard to the mechanism so as to apply a force to the mechanism, when the lanyard is tensioned, to reduce the angle between the arms thereof thereby causing a relative movement of the traversing devices toward one another along the safety line; two pairs of cooperating stop means provided on the arms for engagement with one another to limit the extreme relative pivotal movements of the arms towards one anohter, and away from one another, respectively; and actuating means acting to increase the angle between said arms, when said lanyard tension is reduced, to cause relative movement of the traversing devices away from one another along the safety line.

12. A safety attachment system comprising an elongate safety line, means for securing the safety line to a fixed structure at the ends of the line and at least at one intermediate location therealong, a pair of traversing devices for sliding engagement along the safety line each of which being adapted to traverse each intermediate securing means of the safety line without detachment from the line and having a pivotal load connector member, and a link mechanism comprising a pair of pivotally mounted arms arranged in a generally V-shaped configuration and being pivotally mounted on a hub member, the arms being attached at their free ends, respectively, to a pivotal load connector member provided on said traversing devices respectively; means for attaching an end connector of a lanyard to the hub member so as to apply a force to the mechanism, when the lanyard is tensioned, to reduce the angle between the arms, thereby causing a relative movement of the traversing devices toward one anohter along the safety line; and actuating means acting between the arms and the hub member to increase the angle between said arms, when said lanyard tension is reduced, to cause relative movement of the traversing devices away from one anohter along the safety line.

13. A safety attachment system according to claim 12, wherein each traversing device comprises at least one wheel having recesses formed in its periphery at spaced locations therearound and separated by projecting parts of the wheel; a cooperating slipper member mounted on the wheel to form a unitary structure therewith, and adapted and arranged to allow rotation of the wheel about its axis with respect to the slipper member while locating the elongate safety line with respect to the wheel such that when the device is moved along the safety line, intermediate support members for securing the safety line to a fixed structure are received, guided and passed through the device in the recesses of the wheel which then rotates relative to the slipper member while the safety line is located with respect to the wheel by the slipper member; and a load connector element pivotally mounted on the traversing device.

* * * * *